United States Patent [19]

Tennis

[11] 3,934,742

[45] Jan. 27, 1976

[54] VALVE MECHANISM FOR AUTOMATIC CONTROL OF A NUMBER OF FLUID MOTORS

[75] Inventor: Francis H. Tennis, Oconomowoc, Wis.

[73] Assignee: Hydraulic Industries, Inc., Hartland, Wis.

[22] Filed: Dec. 26, 1973

[21] Appl. No.: 427,806

[52] U.S. Cl. ..... 214/762; 91/412; 91/414; 137/596; 137/596.12

[51] Int. Cl.[2] ..... E02F 3/28; F15B 13/06

[58] Field of Search ..... 91/412, 414; 137/118, 119, 137/596, 596.12, 596.13; 214/138 R, 762

[56] References Cited

UNITED STATES PATENTS

| | | | |
|---|---|---|---|
| 3,145,734 | 8/1964 | Lee et al. | 137/596.13 |
| 3,225,781 | 12/1965 | Kruger et al. | 137/596.13 X |
| 3,455,210 | 7/1969 | Allen | 137/596.13 X |
| 3,465,519 | 9/1969 | McAlvay et al. | 137/596.13 X |
| 3,488,953 | 1/1970 | Haussler | 91/414 X |
| 3,602,104 | 8/1971 | Stremple | 137/596.13 X |
| 3,718,159 | 2/1973 | Tennis | 137/596.12 |
| 3,722,543 | 3/1973 | Tennis | 137/596.12 |
| 3,782,404 | 1/1974 | Hodgson | 137/118 X |
| 3,807,447 | 4/1974 | Masuda | 137/596.13 |
| 3,811,471 | 5/1974 | Murase et al. | 137/596.13 |
| R26,338 | 1/1968 | Allen | 137/117 |

*Primary Examiner*—Alan Cohan
*Assistant Examiner*—Gerald A. Michalsky

[57] ABSTRACT

A spool type control valve mechanism for use with backhoes, front end loaders, and other apparatus having a number of hydraulic cylinder driven work performing members whose motions must be coordinated in order to produce a prescribed work operation. Pressure compensating valve means which provides for regulation of the rate of flow to the cylinders of pressure fluid from a common supply passage also functions automatically to control connection of the cylinders with the supply passage in accordance with the work load on the cylinders, at times when the valve spools of all the control valves are in their working positions.

11 Claims, 6 Drawing Figures

DIG
CURL
LIFT

VALVE MECHANISM FOR AUTOMATIC CONTROL OF A NUMBER OF FLUID MOTORS

BACKGROUND OF THE INVENTION

This invention relates to valve mechanisms of the type employed for the control of hydraulic cylinders or other fluid motors, and has more particular reference to the provision of valve mechanism for automatically controlling and coordinating the motions of a number of hydraulically operated work performing members which must be actuated singly and/or in concert in order to effect a desired work cycle.

Front end loaders and backhoes are but two examples of apparatus having work performing members that are hydraulically operated, and whose motions must be coordinated to produce a prescribed work operation. In a front end loader, for instance, it is the boom and the bucket on the outer end of the boom whose motions must be coordinated in order to effect the dig cycle of the loader.

In a backhoe, however, there are three hydraulically actuated work performing members whose motions must be coordinated in order to effect a digging cycle. These are its boom, the dipper stick which is pivotally mounted on the outer end of the boom, and the dipper or bucket which is pivotally mounted on the outer end of the dipper stick.

The operator of a backhoe must be highly skilled in the proper manipulation of conventional control valves which govern the motions of the boom, stick and bucket during digging. At the start of a dig cycle, for example, the operator must actuate the stick cylinder control valve to its "crowd" position so that the stick will force the bucket on its outer end into the ground. He must be able to sense when digging prssures rise to an objectionably high level and at that time "curl" the bucket to a less effective digging attitude to relieve excessive digging pressure. He may, at times, also have to stop the digging or "crowd" motion of the dipper stick by its control valve in order to sufficiently reduce the work load on the stick cylinder. Frequently, as in cases where the bucket strikes an obstruction or encounters extremely compact soil, the operator may have to effect elevation of the boom in order to effect the desired reduction in work load on the hydraulically driven members.

From this it will be seen that there can be times when the operator should be able to continually manipulate the actuating levers of all three control valves governing operation of the hydraulically driven stick, bucket and boom. This is exceedingly difficult, and has greatly limited the operation of backhoes to only those persons having the necessary high degree of skill essential to efficient digging.

Efforts have been made in the past to achieve "automatic dig" for backhoes, to enable their operation by unskilled operators such as might be in the employ of contractors who rent such apparatus. These efforts however, have met with more or less indifferent success. Much of the reason for this resulted from the costly and complicated control mechanism which was needed in order to effect "automatic dig." In some cases, two complete sets of controls were required, one to enable manual control of each work performing member, and the other to effect automatic control of the hydraulic cylinders for the work performing members. The high initial cost and upkeep expense of such a system of automatic dig can be readily appreciated.

SUMMARY OF THE INVENTION

With this in mind it is a purpose of this invention to provide control valve means which, though capable of automatically achieving coordinated operation of a plurality of hydraulic cylinders or other fluid motors, features a degree of simplicity hitherto unheard of in automatic controls for fluid motors.

Thus, it is an object of the invention to provide for automatic and coordinated control of a number of hydraulic cylinders by means of substantially conventional flow control valve mechanisms.

In a more specific sense, it is an object of the invention to provide control valve means for a number of hydraulic cylinders with special pressure compensating valves which not only serve to govern the rate of cylinder operation but also automatically assure the coordinated cylinder operation so essential to efficient digging with backhoes.

With these observations and objectives in mind, the manner in which the invention achieves its purpose will be appreciated from the accompanying drawings, which exemplify the invention, it being understood that changes may be made in the specific apparatus disclosed herein without departing from the essentials of the invention set forth in the appended claims:

The accompanying drawings illustrate two complete examples of the embodiments of the invention constructed according to the best modes so far devised for the practical application of the principles thereof, and in which:

DESCRIPTION OF THE PREFERRED EMBODIMENTS

Figure 1:
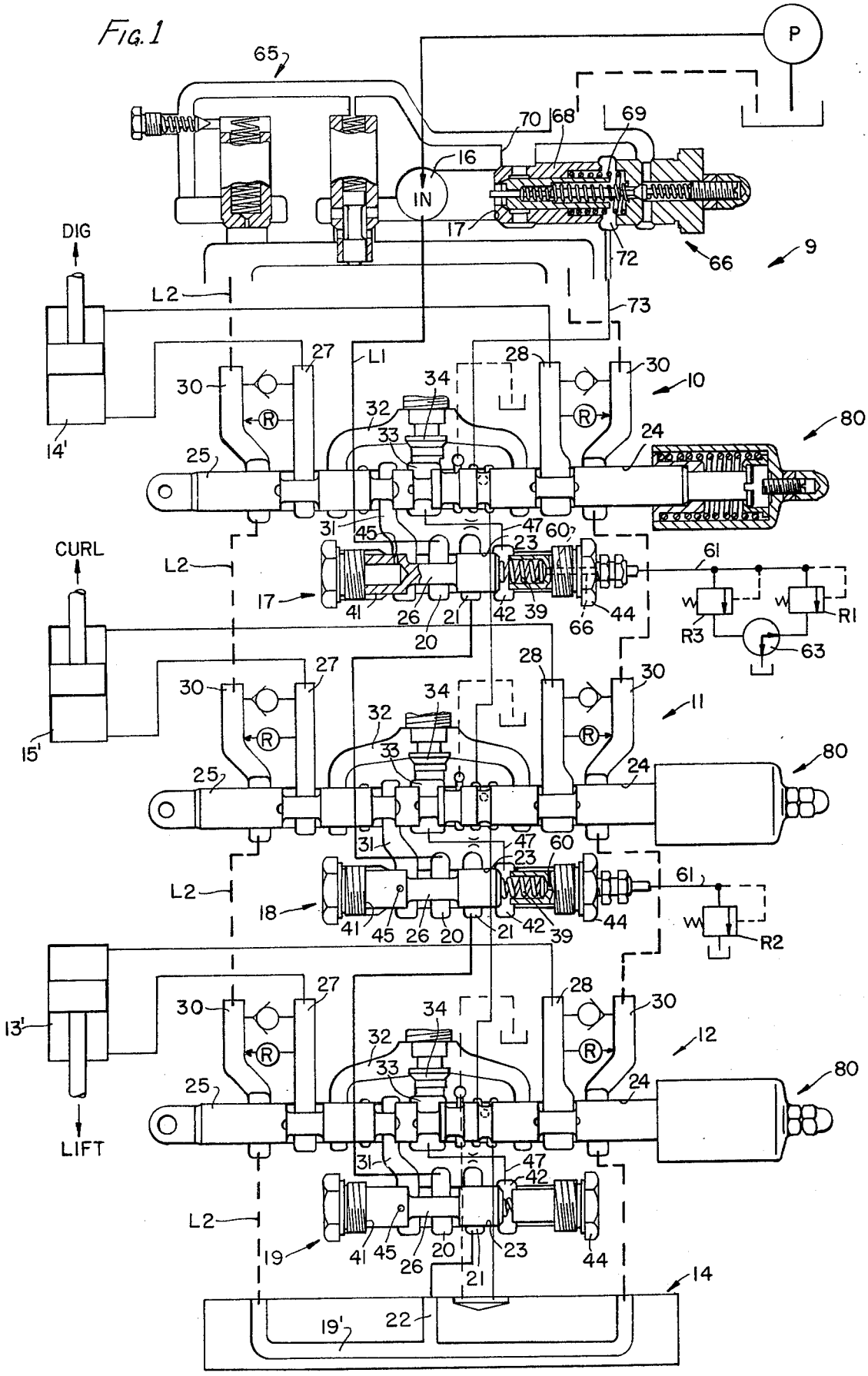
FIG. 1 is a more or less diagrammatic view of a stacked control valve comprising three valve sections, and embodying the principles of this invention.

Referring now to the accompanying drawings, the control valve mechanism 9 seen in FIG. 1 illustrates a stacked valve which is comprised of three control sections 10, 11 and 12. The valve of FIG. 1 corresponds to the open center priority type control valve disclosed in FIG. 2 of U.S. Pat. No. 3,722,543 issued to Francis H. Tennis March 27, 1973, to which reference may be had for a more complete description of the valve and its operation. There are, however, certain important improvements in the control valve of this invention, which will be discussed at greater length hereinafter.

Strictly by way of example, the control valve mechanism of FIG. 1 can be considered as one which is provided in a backhoe to have the motions of its dipper stick, bucket and boom governed by the valve sections 10, 11 and 12, respectively.

Figures 2, 3, 4:
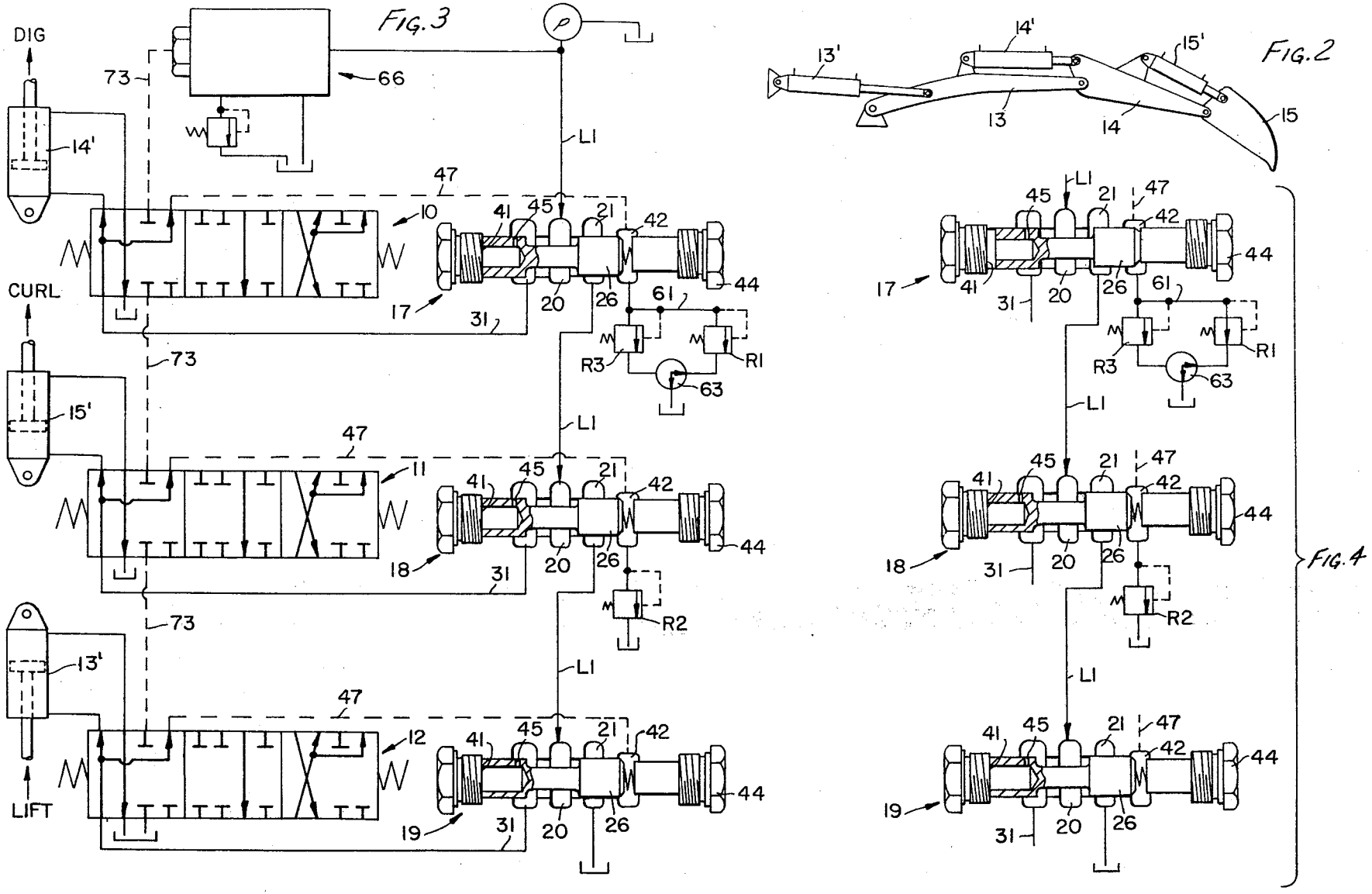
FIG. 2 is a diagrammatic view of the three work performing members of a backhoe, showing the same in the extended positions they occupy at the start of a digging cycle.
FIG. 3 is a schematic view in which graphic symbols represent the control valve mechanism when the valve spools of all of them are in their automatic dig positions.
FIG. 4 is a diagrammatic view showing how the pressure compensating valve mechanisms seen in FIGS. 1 and 3 operate to relieve excessive work pressure during the digging cycle.

Reference may be had to FIG. 2 for a diagrammatic representation of these work performing members of a backhoe and the hydraulic cylinder therefor. As therein seen, the numerals 13, 14 and 15 respectively designate the boom, dipper stick and bucket, while the numerals 13′, 14′ and 15′ respectively represent their double acting drive cylinders. As is customary, the inner end of the boom is pivotally supported on the frame structure (not shown) of the backhoe; the inner end of the dipper stick is pivotally connected to the outer end of the boom; and the bucket is pivotally mounted on the outer end of the dipper stick.

The control sections 10, 11 and 12 are respectively provided with pressure compensating valve mechanisms 17, 18 and 19, and they are respectively located greater distances from the inlet 16 with which they are connected via a common pressure fluid supply passage L1. The body of each control section is formed with a pair of parallel bores 23 and 24. A control valve spool 25 is axially slidably received in each bore 24, while the plunger 26 of the associated pressure compensating valve mechanism is axially slidably received in each bore 23.

One end of the supply passage L1 is connected to the valve inlet 16 and its other end is connected to a return port 22 in the bottom section of the stack. The supply passage serially intersects the bores 23 of all three pressure compensating valve mechanisms. It has upstream and downstream branches 20 and 21 respectively which intersect each bore 23 at axially adjacent zones, and the downstream branches 21 of each of the control sections 10 and 11 can be said to be portions of the upstream branches 20 of the control sections 11 and 12.

The stick control valve 10 has service ports 27 and 28 which are respectively connected with the head and rod ends of the stick cylinder 14′; the bucket control valve 11 has similar service ports 27 and 28 which are respectively connected with the head and rod ends of the bucket cylinder 15′; and the service ports 27 and 28 of the boom control valve have been shown as respectively connecting with the rod (lift) and head ends of the boom cylinder 13′.

Supply fluid from the passage L1 is directed to one or the other of the service ports 27, 28 of each control section by its valve spool via a feeder passage having a first branch 31 that bridges the bores 23, 24 of its associated control section. Each such feeder branch joins with the bore 23 of the associated pressure compensating valve mechanism at a zone spaced from the junction between said bore and the adjacent upstream branch 20 of the supply passage and at the side thereof remote from the junction of the downstream supply branch 21 with the bore 23.

The feeder branch 31 and a second branch 33 thereof intersect the bore 24 in each control section at axially spaced zones which are communicable with one another through circumferential grooves in the valve spool 25 when the latter is shifted out of neutral to working positions at either side of neutral.

The second or downstream feeder branch 33 in each valve section leads to an inverted U-shaped bridge passage 32 through a check valve 34. The bridge passage can be said to comprise a third branch of the feeder passage, and its opposite legs are disposed inwardly adjacent to the service ports to be selectively communicable therewith through the bore 24 under the control of the valve spool therein.

Return or reservoir passages 30 in each control section intersect its bore 24 at locations outwardly adjacent to the service ports, to likewise be selectively communicable therewith under the control of the valve spool 25 in said bore.

The valve spool 25 in section 10 will, when shifted to a dig position to the right of neutral, as seen in FIG. 3, direct pressure fluid from supply branch 20 through the feeder passage branches 31, 33, 32 and the bore 24 to service port 27 connecting with the head end of the stick cylinder 14′. This will cause extension of the piston in said cylinder and "crowd" or downward digging motion of the dipper stick 14. Fluid exhausting from the rod end of cylinder 14′ will be returned to service port 28 for flow to the adjacent reservoir passage 30.

It should be noted, however, that pump fluid entering the inlet 16 ordinarily flows through an unloading valve 66 to a tank-connected bypass port 70. Consequently, actuation of any one of the valve spools 25 to a working position must effect closure of the unloading valve before supply fluid can flow through passage LI to its upstream feeder branch 31. The nature and operation of the unloading valve will be discussed at greater length hereinafter.

In all cases, supply fluid flowing to any feeder branch 31 must first pass through the bore 23 of its pressure compensating valve 17.

As explained in my aforesaid U.S. Pat. No. 3,722,543, the plungers 26 in all of the pressure compensating valve mechanisms are of the priority or series parallel type. This is to say that in the right hand or dig position of the valve spool 25 in either control section 10 or 11, the plunger 26 of its compensating valve 17 will occupy a position blocking flow of supply fluid through its downstream supply branch 21 to the pressure compensating valve mechanism of the next control section. Hence, if the spool of only the stick control valve 10 is actuated to an operating position, pressure fluid from the source can flow only to the service passage 27 of the stick control valve 10, and to the head or dig end of the stick cylinder 14′.

When all the valve spools are in their neutral positions seen in FIG. 1, however, the plungers 26 of all of the pressure compensating valve mechanisms 17, 18 and 19 are held in what can be referred to as closed positions at which they block fluid flow from their upstream to their downstream supply passage branches 20, 21. Substantially strong springs 39 in actuating chambers 42 at the right hand ends of the plungers act thereon to yieldingly urge the same to their closed positions.

The left hand end of each plunger 26 extends into an actuating chamber 41, to be acted upon by pressure of supply fluid in its associated upstream feeder branch 31. For that purpose, radial holes 45 are formed in the plungers 26, to communicate their chambers 41 with the upstream feeder branches 31 via the hollow left hand end portions of the plungers.

Each pressure compensating plunger serves to regulate the flow of supply fluid to its upstream feeder branch 31 in accordance with variations in the pressure differential between said upstream feeder branch and its associated downstream branch 33. This is to say, that when any one of the valve spools 25 is in a working position, the plunger of its associated pressure compensating valve mechanism will be moved in response to variations in the pressure drop across said spool, upstream from its associated load holding check valve, in directions such as to restore the pressure drop to a value which corresponds to the desired speed of motor operation, thus assuring that the motor will be operated at a uniform rate.

At such time, the pressure of supply fluid in the upstream feeder branch 31 is imposed upon a surface on the left hand end of the plunger in its chamber 41, and the left hand end of the plunger is subjected to a fluid pressure corresponding to that present in the associated downstream feeder branch 33.

For this purpose, a duct 47 connects the downstream feeder passage branch 33 of each valve section to the spring chamber 42 of its associated pressure compensating mechanism, so that the end of the plunger in said chamber will be subjected to a so-called feedback force which varies with the load on the governed motor. This feedback force, of course, opposes the force which supply fluid in the associated feeder branch 31 exerts on the left hand end of the plunger in chamber 41.

According to this invention, the pressure compensating valve mechanisms 17 and 18 of the first and second control sections 10 and 11 are provided with relief valves R1 and R2 respectively, which are adapted to vent the spring chambers 42 of their associated pressure compensating valves when the pressures of feedback fluid therein rise to predetermined relief values. For this purpose, a passage 60 is provided in the plug 44 closing the right hand end of the bore 23 in each of the control sections 10 and 11. These passages open inwardly to the spring chambers 42, and their outer ends are connected by ducts 61 with the inlets of the associated relief valves R1 and R2.

Thus, if the pressure of feedback fluid in the spring chamber 42 of the compensating valve mechanism 17 rises to an excessively high value, of say 2500 p.s.i. for example, the relief valve R1 will open to connect said chamber 42 to tank and thereby relieve it of said excessive pressure. As soon as chamber 42 is vented by relief valve R1 in this fashion, the pressure of supply fluid in chamber 41 at the opposite end of the mechanism 17 will effect actuation of the plunger 26 thereof to its bypass open position at which it disrupts flow of supply fluid to the upstream feeder branch 31 and allows supply fluid to flow to the inlet of the pressure cmpensating valve mechanism 18 for the bucket control section 11.

The relief valve R2 for the spring chamber of the bucket control compensator 18 similarly effects actuation of the compensating plunger 26 thereof to bypass open position at which it blocks supply fluid flow to the associated upstream feeder branch 31 while allowing supply fluid to flow to the inlet of the pressure compensating valve mechanism 19 for the boom control valve 12. The relief valve R2, however, is preferably set to open when pressure of feedback fluid in the associated spring chamber reaches a value higher than the relief setting of the valve R1 of the dipper stick compensator 17, for example at about 2900 p.s.i.

These relief valves are of the essence of the invention, in that they not only allow their respective pressure compensating valve mechanisms to regulate the speed of cylinder operation in accordance with variations in the load thereon, but more importantly, they cause the pressure compensating plungers to act as automatic shut-off valves for their associated control sections at times when working pressures in the cylinders governed thereby rise to predetermined high values. This is to say, that a plural spool control valve mechanism like that of my aforesaid U.S. Pat. No. 3,722,543 can be readily converted to one that achieves automatic dig merely through the provision of suitable relief valves for the spring chambers of its stick and bucket compensator valves.

Referring now particularly to the FIG. 3 diagram, it will be seen that an automatic digging cycle will be carried out when the boom, dipper stick and bucket of the backhoe are in their extended positions seen in FIG. 2, and the valve spools 25 of all three control sections are actuated to their right hand working positions which they must occupy in order to effect downward digging motion of the dipper stick, inward curling of the bucket, and lifting of the boom.

Because of the priority type plungers 26 in the pressure compensating valve mechanisms 17 and 18, only the stick cylinder 14' will then receive pressure fluid to start the digging action produced by downward movement of the dipper stick. The digging movement of the stick will continue until the pressure of fluid in the expanding end of the stick cylinder, as manifested in the downstream feeder branch 33 of the stick control valve 10 and spring chamber 42 of its pressure compensating mechanism 17 reaches and/or exceedss the 2500 p.s.i. relief setting of the relief valve R1 thereof.

When that load pressure is reached, the spring chamber 42 of the compensator 17 is vented through its relief valve R1 and the compensating plunger thereof responds to the resulting greatly increased pressure differential across its ends by moving to the right to its position seen in FIG. 4, at which it disrupts flow of supply fluid to the stick cylinder and at the same time opens the supply passage to the inlet of the pressure compensating valve mechanism 18 for the bucket control valve. Note that the control spool 25 for the stick cylinder should be kept in its "dig" position at this time.

Pressure fluid from the supply passage L1 is then directed to the "curl" (head) end of the bucket cylinder 15' by the valve spool of the second control section 11, to curl the bucket inwardly to a less positive digging attitude. This will ordinarily relieve the work load on the bucket cylinder to the extent that the resulting decreased fluid pressure force exerted on the left hand end of the plunger in the chamber 41 of the dipper stick compensator can no longer overcome the opposing force of the strong spring 39 on said plunger. At that time, the plunger 26 in the stick compensator 17 is propelled to its left hand position by its spring, to again open the supply passage to the upstream feeder branch 31 of the stick valve 10 and also block flow of supply fluid to the bucket control valve 11.

In the way, the "curl" motion of the bucket is halted, and the crowd motion of the dipper stick is resumed.

In the event that digging pressure is not relieved during curling of the bucket as described above, the relief valve R2 will open when the pressure in the curl end of the bucket cylinder, as manifested in the spring chamber 42 of compensator 18, reaches a second predetermined value of, for example, 2900 P.S.I. This causes the plunger 26 of the bucket compensator to be actuated to its right hand limit of motion at which it disrupts flow of supply fluid to the bucket cylinder and opens the supply passage to the inlet of the pressure compensating valve mechanism 19 for the boom control valve 12. As a result, pressure fluid is then directed to the "lift" end of the boom cylinder 13' to effect raising of the boom the extent necessary to relieve the excessive digging pressures in the bucket and stick cylinders.

These pressures are then quickly reduced to values at which the springs 39 acting on the plungers in the compensators 17, 18 and 19 are able to shift the plungers back to their left hand positions. This, of course, automatically renders the stick cylinder operative and digging is resumed by the dipper stick while the bucket and boom cylinders remain in an inactive state.

From this it will be seen that a dig cycle of the work performing members will be automatically effected, although a complete cycle may involve curling of the bucket and/or lifting of the boom several times, depending upon the nature and density of the earth being excavated.

If desired, the compensator 17 for stick control valve 10 can be provided with a second relief valve R3, which is connected in parallel with the valve R1, and which may have a lower relief setting. Merely by way of example, the valve R3 can be set to open at a pressure of 2750 p.s.i.

When two such relief valves R1 and R3 are connected in parallel with one another and with the spring chamber 42 of the pressure compensating valve mechanism 17, a manually operable selector valve 63 is connected with the outlets of the relief valves to enable one or the other thereof to be effective. In this way, "high" and "low" relief settings for the compensator 17 are available choices to the operator of the apparatus, and he can readily select whichever setting is best suited for existing digging conditions.

It should also be apparent that, if desired, the spring chambers 42 in the compensators of both the stick and bucket control valves 10 and 11 could be connected to the inlet of a common relief valve; or separate relief valves could be provided therefor but having the same relief setting. In such cases, an overload condition in the hydraulic system during digging serious enough to open the common relief valve or separate valves would result in closing off of the stick and bucket control valves from the supply passage and lifting of the boom by its cylinder to effect reduction of digging pressures.

Another important feature of the control valve mechanism of this invention resides in the provision of its inlet section 65 with an unloading valve mechanism 66. This mechanism features a poppet 68 that is only very lightly urged toward closed position by a spring 69 which is substantially weaker than the strong springs 39 that act upon the pressure compensating plungers.

The inlet 16 of the control valve mechanism is located in the end section 65, and it is communicable with a tank-connected bypass port 70 through an annular valve seat 71 that is normally engaged by the poppet 68 under the relatively light force exerted thereon by its spring 69. Pressure fluid in the inlet 16 at all times exerts opening force on the seat engaging end of the poppet, but it can only be moved off of its seat at times when all of the valve spools 25 are in their neutral positions seen in FIG. 1. At that time, a pressure chamber 72 containing the end of the poppet remote from its seat 71 is vented through a reservoir connected passageway 73 that extends serially through the bores 24 of all the valve spools 25 to be controlled by said spools.

Only slight movement of any one of the valve spools 25 will effect closure of the reservoir passageway 73 to allow pressure fluids from the inlet to flow into the chamber 72 behind the unloading poppet and exert closing thereon to hold it closed against the opening force which fluid at the same pressure exerts upon its seat engaging end. For this purpose, the chamber 72 is communicated with the inlet 16 in any desired fashion, as by means of an axial passage leading through the poppet from front to rear thereof.

The control valve mechanism described can be characterized as an open center priority type. It functions as a priority valve because its pressure compensating plungers 26 are so designed to allow flow of supply fluid to their respective control sections while blocking flow to any downstream control section. It is an open center type valve because the downstream supply branch 21 of the last central section 12 is connected to a return port 22 in the bottom section 14 of the stack.

Figure 6:
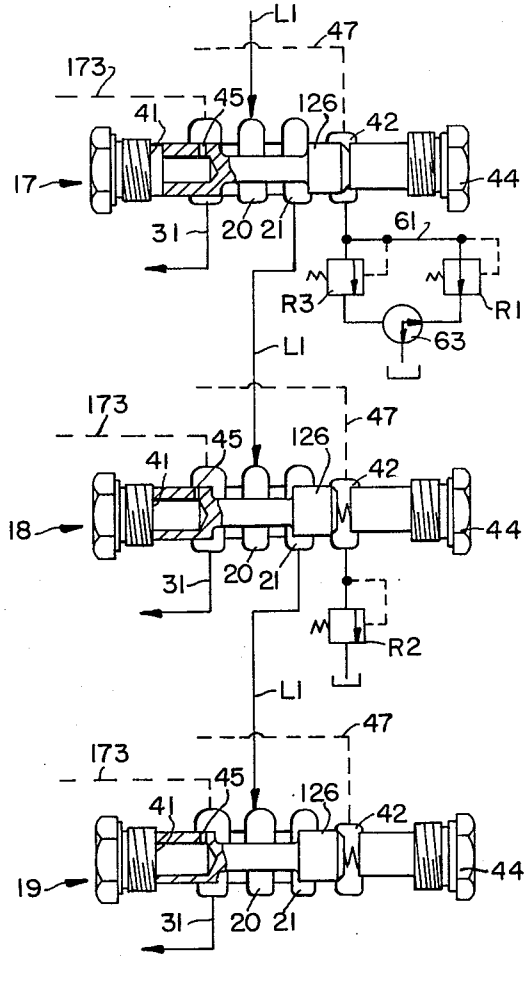
FIGS. 5 and 6 are diagrammatic views similar to FIGS. 3 and 4, respectively, but illustrating a modified embodiment of the invention.
Figure 5:
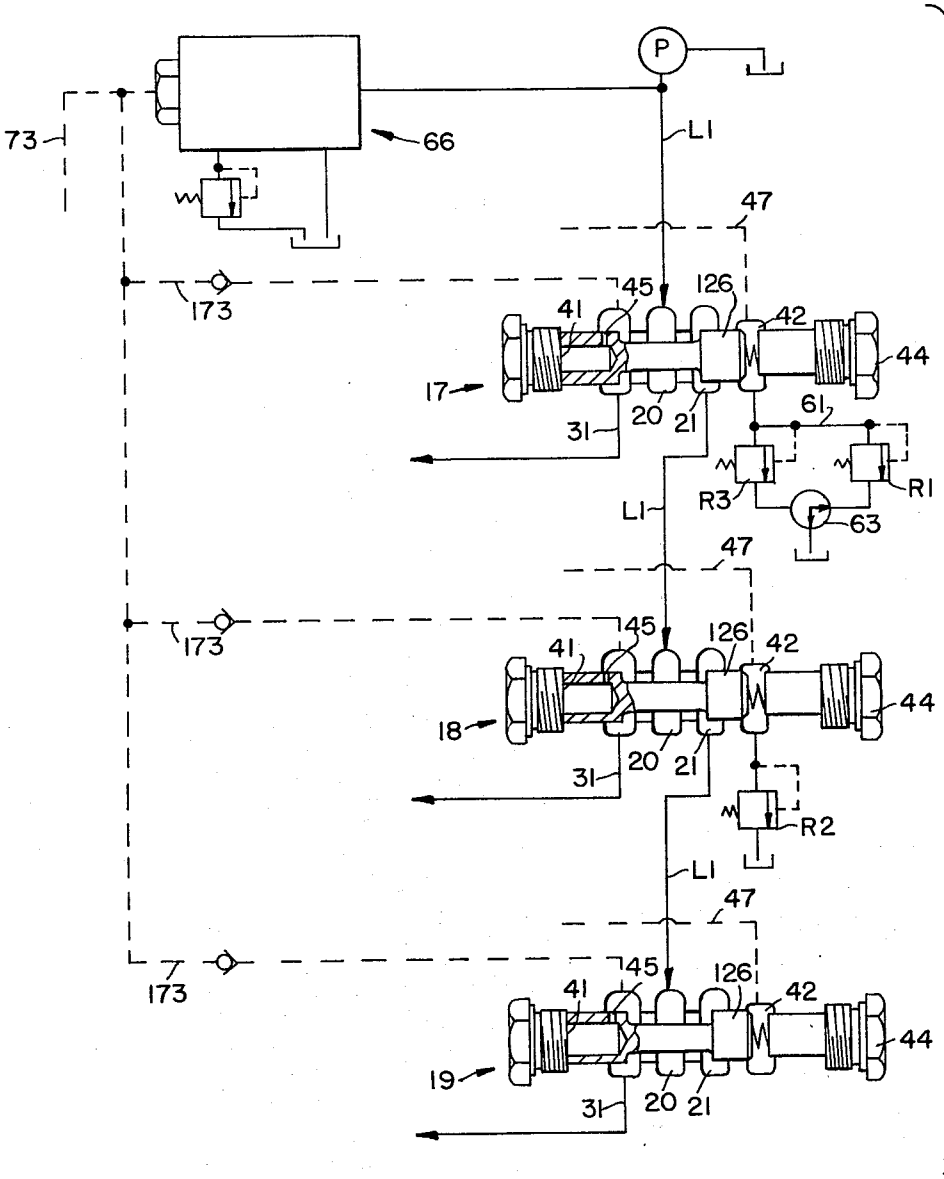

The control valve shown in FIGS. 5 and 6 is of the closed center parallel type, on the order of that seen in FIG. 7 of my aforesaid U.S. Pat. No. 3,722,543. It distinguishes from the open center priority valve in that the downstream supply passage branch 21 of the boom control pressure compensator 19 is dead ended at the bottom section of the stack; its pressure compensating plungers 126 are formed with a wider circumferential groove therein so that they are capable of disrupting flow of supply fluid to only their respective upstream feeder branches 31; and the unloading valve chamber 72 is pressurized by fluid from the upstream feeder branch 31 of any one control section upon shifting of the spool thereof to a working position. Pilot lines 173 are provided for this last mentioned purpose.

It is a feature of the valve mechanism seen in FIGS. 5 and 6 that it can automatically effect stick crowd, bucket curl and boom raising motions by their cylinders all at the same time. For such operation, however, it may be necessary to restrict the stroke of the valve spools, as by adjustable stop mechanisms 80 such as seen in FIG. 1, so as to effect flow of supply fluid to the bucket and boom cylinders, for example, in metered amounts.

Again, to initiate a digging cycle, the control spools of the stick, bucket and boom control spools are actuated to crowd, curl and lift positions respectively. The drive cylinders for these work performing members than become operative, although it will be understood that fluid flow to the bucket and boom cylinders may be limited to very slowly cause bucket curl and boom lift while the stick is more rapidly advanced in the dig direction.

In the event digging pressure in the stick cylinder then rises to a value sufficiently high as to effect opening of the relief valve R1 of the stick compensator 17, the plunger thereof will be actuated to its right hand limit of motion at which it disrupts flow of pressure fluid to the dig end of the stick cylinder (see FIG. 6). Supply fluid will continue to flow in metered amounts to the bucket and boom cylinders, so as to thus rapidly and automatically effect reduction in the work load to the value at which the plunger of compensator 17 is spring propelled back to its "crowd" position at which supply fluid is again able to flow to the dig end of the stick cylinder, to cause digging action by the stick to be resumed.

The parallel type of valve described can be used to advantage in a front end loader, to achieve automatic control over the boom and bucket cylinders during a digging cycle. In that case, the boom is elevated by its cylinder to effect the digging action, and the pressure compensator associated with its control valve will shut off flow of supply fluid to the boom cylinder whenever digging pressure therein rises to the relief setting of the boom compensator. Subsequent curling of the bucket will reduce digging pressure to the point where the plunger of the boom compensator is returned to its original position, after which the lifting or digging action of the boom is resumed.

In this case also, the stroke of the spool for the bucket control valve will have to be limited, to effect slow curling action of the bucket during the digging cycle.

From the foregoing description, together with the accompanying drawings, it will be readily apparent that this invention makes it possible to achieve automatic and coordinated operation of a number of hydraulically driven work performing members with substantailly simple and low cost control valve mechanism.

Those skilled in the art will appreciate that the invention can be embodied in forms other than as herein disclosed for purposes of illustration.

The invention is defined by the following claims:

I claim:

1. Means for governing operation of first and second hydraulic motors each of which has a work performing element for connection with a load and an operating port to which pressure fluid can be delivered to effect actuation of the load, characterized by:

A. respective first and second motor control valves, each having a service port connected with the operating port of its motor, and a valve spool movable to a working position at which it communicates said service port with a pressure fluid supply port common to said valves;

B. a flow control mechanism connected with said control valves; through which pressure fluid from said common supply port must flow to reach the operating port of each motor, said mechanism having a valve member movable from a first position providing for flow of supply fluid to the operating port of said first motor to a second position obstructing such flow and providing for flow of supply fluid to the operating port of the second motor providing the spool of said second control valve is in its working position;

C. means to hold said flow control valve member in its said first position in response to the pressure of fluid present in the service port of said first control valve in said working position of the spool thereof;

D. means so interlinking said work performing elements that the load on the first motor can be reduced in consequence of movement of said flow control valve member to its second position at times when said valve spools are concurrently in their working positions;

E. and means rendered operative in consequence of and whenever the load on the first motor causes pressure at the service port of the first control valve to rise to a predetermined high value at said times when both spools are in their working position, for effecting actuation of said flow control valve member to its second position to thereby automatically provide for reduction of the load on the first motor.

2. The motor governing means of claim 1, further characterized by:

A. said flow control mechanism comprising a pressure compensating valve having pressure chambers into which spaced apart portions of the valve member project to be acted upon by pressure fluid therein;

B. spring means in one of said chambers yieldingly urging the valve member toward said first position thereof;

C. duct means through which said spring chamber can be pressurized by supply fluid directed to the service port of said first control valve;

D. other duct means through which the other of said chambers can be pressurized by supply fluid in the feeder passage of said first control valve, whereby the pressure of such supply fluid in said other chamber can effect actuation of the valve member to said second position thereof provided that pressure fluid is able to exhaust from said one chamber;

E. and a relief valve connected with said one chamber and through which fluid can be exhausted at times when the pressure in said one chamber exceeds said predetermined high value.

3. The motor governing means of claim 1, further characterized by:

A. said flow control valve mechanism comprising a chamber which is subjected to pressure of a value corresponding to that of supply fluid entering the service port of the first control valve, and which chamber must be relieved of pressure before said flow control valve member can be actuated to its said second position;

B. and a relief valve connected with said chamber and adapted to open whenever pressure therein rises to said predetermined high value.

4. The motor governing means of claim 3, further characterized by:

A. a second relief valve connected with said chamber and adapted to open whenever pressure therein exceeds a second predetermined value substantially differing from said first designated high value;

B. and a selector valve independent of said valve spools, to operatively couple one or the other of said relief valves with said chamber.

5. The motor governing means of claim 1, further characterized by:

A. a third hydraulic motor having an operating port and a work performing element so interconnected with that of the second motor that an excessive load on the second motor is reduced in consequence of delivery of pressure fluid into the operating port of said third motor;

B. a third one of said control valves having its service port connected with the operating port of the third motor and connectable with said supply port by its spool upon movement thereof to a working position which it must occupy in order to provide for automatic actuation of said third motor at times when the load on said second motor becomes excessive;

C. a second one of said flow control mechanisms connected with said first and second control valves, and through which supply fluid must flow to reach the service ports of said second and third control valves, said second flow control mechanism having a valve member which is movable from a first position providing for flow of supply fluid to the service port of said second control valve to a second position obstructing such supply fluid flow and providing for flow of supply fluid to the service port of the third control valve;

D. means operable in response to the pressure of fluid directed to the service port of the second control valve by the valve spool thereof to hold the valve member of the second flow control mechanism in its said first position;

E. and means rendered operative in consequence of increase in the pressure of supply fluid in the service port of the second control valve to a predetermined high value substantially greater than said first designated high value, for effecting actuation of the valve member of the second flow control mechanism to its second position obstructing supply fluid flow to the service port of the second control valve and providing for flow of supply fluid to the service port of said third control valve for as long as said greater pressure condition prevails.

6. The motor governing means of claim 5 further characterized by a backhoe having:

A. a boom mounted for up and down pivotal motion about an axis adjacent to one end thereof;

B. a dipper stick supported at one end portion from the outer end of the boom for pivotal motion toward and from the underside thereof;

C. a dipper supported from the outer end of the stick for pivotal motion toward and from the underside of the stick;

D. said hydraulic motors having their work performing elements operatively connected to the stick, the dipper and the boom to effect such pivotal motions thereof;

E. the service ports of said first, second and third control valves being connected with said stick, dipper and boom motors, respectively, to in turn effect dig motion of the stick toward the underside of the boom, curling of the dipper toward the underside of the stick, and finally lifing of the boom in the event load pressures at the service ports of said first and second control valves continue to rise to said predetermined high values at times when the valve elements of all three control valves are simultaneously in said working positions thereof.

7. The valve means of claim 5, further characterized by:

A. each of said flow control mechanisms comprising a chamber which is subjected to pressure of fluid of a value corresponding to that in the service port of its associated control valve, and which chamber must be relieved of pressure before the valve member of said mechanism can move to said second position thereof;

B. and a pair of relief valves, one for each flow control mechanism and connected with said chamber thereof to provide for relief of pressure therein at a predetermined high relief value, the relief valve for said second flow control mechanism being adapted to open at a pressure which is greater than the relief setting of the relief valve for said first designated flow control mechanism.

8. The hydraulic motor governing means of claim 5, wherein the valve member of said second flow control mechanism is operable in its said first position to block flow of supply fluid to the operating port of the third motor.

9. The hydraulic motor governing means of claim 5, wherein the valve member of said second flow control mechanism is operable in said second position thereof to block flow of supply fluid to the operating port of the second motor.

10. The hydraulic motor governing means of claim 1, wherein flow of supply fluid to the operating port of the second motor is blocked by the flow control valve member in said first position thereof.

11. The hydraulic motor governing means of claim 1, wherein flow of supply fluid to the operating port of the first motor is blocked by said flow control valve member in said second position thereof.

* * * * *